US007748191B2

(12) United States Patent
Podirsky

(10) Patent No.: US 7,748,191 B2
(45) Date of Patent: Jul. 6, 2010

(54) CLADDING APPARATUS AND METHODS

(75) Inventor: Bernhard Podirsky, Arundel (AU)

(73) Assignee: B-Pods Holdings Pty Ltd., Queenland (AU)

( * ) Notice: Subject to any disclaimer, the term of this patent is extended or adjusted under 35 U.S.C. 154(b) by 1306 days.

(21) Appl. No.: 10/476,205

(22) PCT Filed: Apr. 24, 2002

(86) PCT No.: PCT/AU02/00511

§ 371 (c)(1),
(2), (4) Date: May 10, 2004

(87) PCT Pub. No.: WO02/088484

PCT Pub. Date: Nov. 7, 2002

(65) Prior Publication Data

US 2004/0187434 A1 Sep. 30, 2004

(30) Foreign Application Priority Data

| | | |
|---|---|---|
| Apr. 26, 2001 | (AU) | PR 4592 |
| May 9, 2001 | (AU) | PR 4879 |
| Mar. 22, 2002 | (AU) | PR 1308 |

(51) Int. Cl.
*E04D 1/00* (2006.01)

(52) U.S. Cl. ..... 52/536; 52/539; 52/541; 52/546; 52/746.11; 52/96

(58) Field of Classification Search ..... 52/533, 52/536, 539, 541, 546, 746.11, 747.11, 542, 52/560, 471, 96

See application file for complete search history.

(56) References Cited

U.S. PATENT DOCUMENTS 1,427,968 A * 9/1922 Pedersen ..... 52/538

(Continued)

FOREIGN PATENT DOCUMENTS

AU 45519 72 A 2/1974

(Continued)

*Primary Examiner*—Richard E Chilcot, Jr.
*Assistant Examiner*—Chi Q Nguyen
(74) *Attorney, Agent, or Firm*—The Culbertson Group, PC

(57) ABSTRACT

There is provided a roof cladding consisting of elements (10) of recycled plastics, material comprising a body portion (11), a batten engagement portion (12) located at the leading edge (14) of the body portion (11) and a batten back stop (13) being a transverse rib located on the underside of the body portion (11) at a spacing from the batten engagement means (12) determined by the pitch or spacing of the roofing battens (15). The batten engagement portion (12) comprises a downward depending web (16) adapted to bear on the up-slope face of the roofing batten (15), and a lower web (17) extending therefrom to lay adjacent the under surface of the batten (15) in use. The edge of the lower web (17) toward the leading edge (14) is provided with a locking lug (20) in the form of a ridge adapted to pass the batten (15) against the resilient bias of the downward depending web (16) and the lower web (17), to engage the leading face of the roof batten (15). The clearance between the body portion (11) and the lower web (17) is such that the space accommodates the trailing edge (21) of an adjacent roofing element (10) to trap the trailing edge (21) between the underside of the body portion (11) and the batten (15). Further installed security is provided by the backstop (13) engaging the upper leading edge of the adjacent batten (15).

16 Claims, 7 Drawing Sheets

U.S. PATENT DOCUMENTS

| | | | | | |
|---|---|---|---|---|---|
| 4,040,211 | A | * | 8/1977 | Wotherspoon | 52/100 |
| 4,574,536 | A | | 3/1986 | Bamber et al. | |
| 4,603,529 | A | * | 8/1986 | Cronenwett et al. | 52/536 |
| 4,606,164 | A | * | 8/1986 | Mendez | 52/536 |
| 4,622,789 | A | * | 11/1986 | Quinnell | 52/95 |
| 4,662,141 | A | * | 5/1987 | Miko | 52/553 |
| 4,914,885 | A | * | 4/1990 | Baker et al. | 52/520 |
| 5,048,255 | A | * | 9/1991 | Gonzales | 52/533 |
| 5,070,671 | A | * | 12/1991 | Fifield et al. | 52/533 |
| 5,074,093 | A | * | 12/1991 | Meadows | 52/537 |
| 5,305,570 | A | * | 4/1994 | Rodriguez et al. | 52/520 |
| 5,438,810 | A | | 8/1995 | Bullen et al. | |
| 5,636,481 | A | * | 6/1997 | De Zen | 52/95 |
| 6,269,604 | B1 | * | 8/2001 | Pedersen | 52/537 |
| 7,003,922 | B2 | * | 2/2006 | Fifield | 52/302.1 |
| 2003/0089064 | A1 | * | 5/2003 | Faulkner et al. | 52/408 |

FOREIGN PATENT DOCUMENTS

| | | | |
|---|---|---|---|
| DE | 30 25 394 | A1 | 4/1982 |
| DE | 87 05 794 | U1 | 6/1987 |
| FR | 24551146 | A1 | 11/1980 |
| FR | 2 562 591 | A | 10/1985 |
| JP | 10-252224 | A | 9/1998 |
| WO | WO 98/24992 | A | 6/1998 |

* cited by examiner

CLADDING APPARATUS AND METHODS

FIELD OF THE INVENTION

This invention relates to cladding apparatus and methods. More particularly, this invention has application in roofing and thus roofing apparatus, its method of implementation and to a roofing structure formed thereby are, for illustrative purposes described hereinafter with reference to this application. However, the apparatus, methods and structures formed by embodiments of the present invention may readily find application in wall cladding, lining and other structural applications.

SUMMARY OF THE INVENTION

According to a first aspect of the invention, there is provided a cladding method including the steps of:

installing spaced, substantially horizontal battens on a structure to be clad;

installing a cladding member having a body portion having an inner and an outer surface and extending from a leading edge to a trailing edge between opposed side edges, and a batten engagement portion disposed on said inner surface toward said leading edge and adapted to retain said body portion against leading and outward movement relative to a leading batten engaged thereby; and a batten stop portion associated with said inner surface toward the trailing edge thereof and adapted to bear on a leading face an adjacent trailing batten, the batten engagement portion and body portion adjacent said leading edge being mutually configured to retain the trailing edge portion of an adjacent cladding member to said leading batten; and progressively installing further said cladding members to clad said structure.

The structure may comprise an internal or external wall, a roof or a ceiling.

In a further aspect, this invention resides in a cladding member including:

a body portion having an inner and an outer surface and extending from a leading edge to a trailing edge between opposed side edges;

a batten engagement portion disposed on said inner surface toward said leading edge and adapted to retain said body portion against leading and outward movement relative to a leading batten engaged thereby; and a batten stop portion associated with said inner surface toward the trailing edge thereof and adapted to bear on a leading face an adjacent trailing batten, the batten engagement portion and body portion adjacent said leading edge being mutually configured to retain the trailing edge portion of an adjacent cladding member to said leading batten.

The cladding member may be in the form of a roof tile or sheet, board-like cladding member or other conventional element such as a shingle. The cladding member may be provided in the form of a continuous roll or strip. The body may be of any suitable shape such as generally planar, corrugated or otherwise profiled. The profiling may be of a form that permits stacking of the roofing elements for transport. Where the cladding member is formed in discrete elements, side edges of the cladding member may be mutually configured to permit overlap between adjacent elements across the pitch of the roof or width of the wall.

The cladding members may be adapted in a roofing application to be laid from gutter to apex, or in a wall cladding application from the lower portion of the wall to the upper portion, whereby the batten engagement means may be hooked under the batten to entrap the trailing edge portion of the next lower element therebetween. The cladding element may have substantially planar side portions to facilitate lateral overlapping. The first cladding element may comprise a modified cladding element configured to engage its leading batten snugly without a packing piece to replace the trailing edge of an adjacent body portion, or may be supplemented with a packing piece, or a thicker batten employed.

The cladding element may be formed of any suitable material such as metal, timber, or a moldable or extrudable material such as a plastics material. The plastics material may be suitable for prolonged outdoor use. Thus, the plastics material may include ultra-violet stabilisers and other chemicals which are used to provide plastics material with properties suitable for such prolonged outdoor use. Advantageously, the plastic is selected from stabilized recycled plastic, and extruded or moulded plastic material, and may be used as formed or coated.

The batten engagement portion and batten abutment means may take any suitable form permitting their cooperation as above. Where the batten engagement means and batten abutment means extend substantially across the underside of the cladding member body portion, the batten engagement means may be interrupted to allow the installation of the element about the battens between the wall studs or roof truss elements.

In one embodiment of the present invention, the batten engagement portion and the batten are each configured to provide for mutual interengagement. For example, there may be provided a batten which has a recess formed on the intended trailing edge thereof, and wherein the batten engaging means includes a projection in the leading direction that is adapted in use the engage the recess. In a further embodiment of the invention both the leading and trailing edge portions of the cladding member are configured with such batten engagement means, and in this case there may be provided a batten that possesses both leading and trailing recesses.

The recess or recesses may be configured to allow the projection to be urged therein with elastic deformation whereby the projection is retained therein by frictional engagement or by virtue of the respective forms being adapted to clip together by elastic recovery. For example, the recess may comprise an elongate slot into which an elongate projection may be forced against the resilient bias of the material of the batten about the slot. The inner end of the slot may be provided with an enlarged cross section into which a correspondingly formed edge of the elongate projection may clip. In a yet further embodiment of the present invention, the elongate projection and the elongate recess may be mutually configured whereby the cladding member may be slid laterally into engagement with the batten member.

The batten members and cladding members may be provided with a close tolerance fit in clipping embodiments and selective lesser tolerances in sliding-fit embodiments. Further, tolerances may be adjusted to provide for environmental effects such as thermal expansion. For example, the batten and cladding member may be configured whereby the engagement is relieved at the trailing edge of the leading cladding member of a pair of adjacent cladding members to provide for both thermal expansion and any angular displacement on fitting.

The overlapping portions of respective cladding members may be provided with further interengaging lugs and grooves. By this means, a yet further means of engagement is provided, which also may contribute to the weather proofing of the cladding by providing a labyrinth which resists the ingress of wind-blown moisture.

The batten engaging means and batten abutment means may include first and second complementary clipping formations to permit a number of the roofing elements to be clipped together. The first clipping formation may be positioned at the front end of the body on an underneath surface of the body. The second clipping formation may be positioned at the rear end of the tile on the underneath surface of the body.

The first clipping formation may have a downwardly projecting portion which depends from the underneath surface of the body at a positioned spaced from the front end of the body. A lip may extend from the downwardly projecting portion substantially at right angles to the downwardly projecting portion so that a transverse profile of the front end of the body and a first clipping formation defines a channel. An operatively upwardly extending projection may be positioned on the lip.

The second clipping formation may be in the form of an elongate retaining formation spaced from the rear end of the body.

The clipping formation may be positioned so that, in use, when a preceding cladding member is operatively positioned with respect to a subsequent cladding member, the downwardly extending portion and the lip of the first clipping formation and the elongate retaining formation of the second clipping formation defining a partially enclosed volume have a substantially rectangular profile.

In use, the clipping formations may be clipped onto elongate structural elements so that the elongate structural elements extend through the partially enclosed volumes defined by a plurality of the cladding members to comprise a cladding structure.

There may also be provided a roof capping that is complementary to the cladding system of the present invention and comprising an elongate capping body portion having opposed edge portions, each edge portion having batten engagement means as hereinbefore described and adapted in use to overlay and retain the trailing edge portions of respective cladding members located uppermost on respective sides of the pitch of a roof.

According to a further aspect of the invention, there is provided a roofing element which includes:

a body having opposed front and rear ends and opposed sides; and a gutter member connected to and extending from the front end of the body, the body and the gutter member being of a unitary, one-piece construction.

The roofing member of the second aspect of the invention may incorporate the first and second engaging means of the first aspect of the invention.

The roofing members may be configured so that, when the sides overlap as described with respect to the first aspect of the invention, adjacent gutter members also overlap so that a plurality of the roofing members can define an elongate gutter.

The guttered roofing member of the second aspect may be particularly configured to cooperate with elements of the first aspect. Accordingly, the invention extends to a roofing structure which incorporates a plurality of the roofing members of both the first and second aspects of the invention.

In a further aspect this invention resides in a roofing method comprising the steps of:

providing a plurality of gutter elements which each include a roofing body having an integral gutter portion at a leading portion of the body, the body having batten engagement means defining a recess opening toward said leading portion and adapted to locate behind and under a roof batten and a locking lug adapted to engage a leading face of said batten under resilient bias thereof installing said plurality of gutter elements in laterally overlapping relation along a first roofing batten by engagement of said batten engagement means with said first roofing batten and extending to overlay a second roofing batten;

providing a plurality of roofing bodies each having a leading edge, batten engagement means defining a recess opening toward said leading edge and adapted to locate behind and under said second roof batten and the trailing edge of a said gutter element, and a locking lug formed on said batten engagement means and adapted to engage a leading face of said second batten under resilient bias thereof;

installing said plurality of roofing bodies in laterally overlapping relation on said second roofing batten; and continuing to install said roofing bodies on subsequent roofing battens in like manner to complete a roofing surface.

In a further aspect the invention resides in a roofing member including:

a roofing body having a leading edge;

batten engagement means defining a recess opening toward said leading edge and adapted to locate behind and under a roof batten and the trailing edge of an adjacent roofing tile overlaying said batten; and a locking lug formed on said batten engagement means and adapted to engage a leading face of said batten under resilient bias thereof.

The roofing body may be provided with a locating means spaced from the batten engagement means and adapted to located against a face of the next adjacent batten up the pitch of the roof.

Particular embodiments of the present invention may take advantage of the particular advantages of precise location to permit addition of further features. For example, there may be provided a roofing member having a passages formed therein to permit the circulation of a working fluid, the adjacent elements being mutually configured to permit a circuit of said fluid to be formed throughout the roof surface. By this means a thermal fluid may be circulated to permit deicing of the roof, or alternatively the roof may be used as a heating means for a fluid. The heat harvested may be put to purposes such as pool heating, hot water preheating or the like.

BRIEF DESCRIPTION OF THE DRAWINGS

The invention will be further described with reference to preferred embodiments thereof as illustrated in the accompanying drawings and wherein.

DESCRIPTION OF PREFERRED EMBODIMENTS

Figure 1:
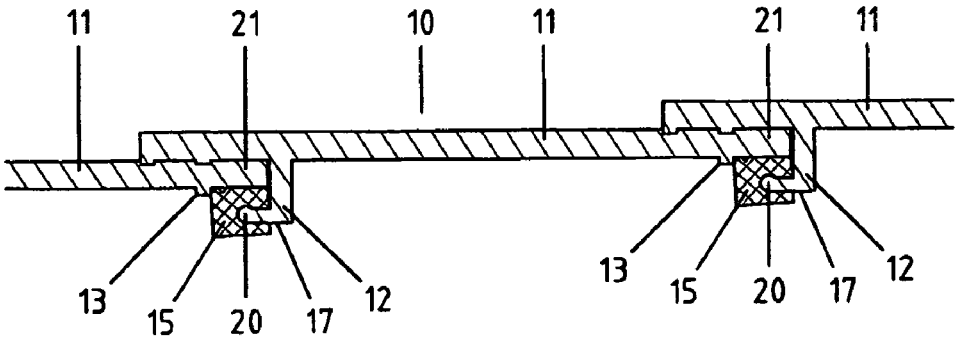
FIG. 1 is a side view of a roof assembly in accordance with the present invention.
Figure 2:
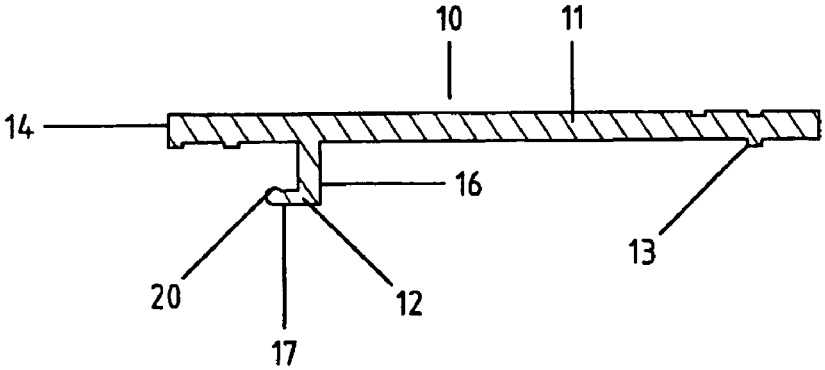
FIG. 2 is a side view of a roofing member in accordance with the present invention.
Figure 3:
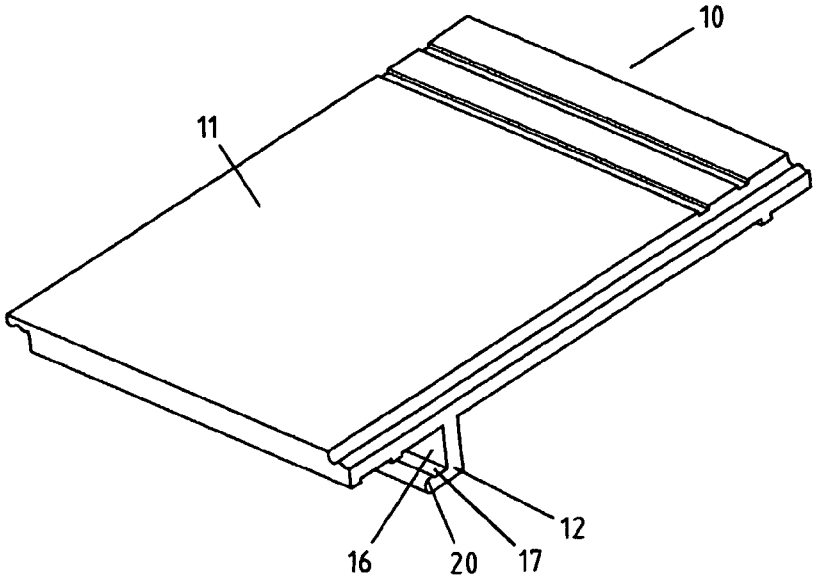
FIG. 3 is a part perspective view of the apparatus of FIG. 2.

In the FIGS. 1 to 3 there is provided a roofing element indicated generally as 10 which has been integrally moulded of thermoformable, recycled plastics material. The roofing element 10 comprises a body portion 11, a batten engagement portion 12 and a batten back stop 13. The batten engagement portion 12 is located in the region of the leading edge 14 of the body portion 11, which is defined as the down-slope edge of the roofing element. The batten backstop 13 is a transverse rib located on the underside of the body portion 11 at a spacing from the batten engagement means 12 determined by the pitch or spacing of the roofing battens 15.

The batten engagement portion 12 comprises a generally downward depending web 16 adapted to bear on the up-slope face of the roofing batten 15, and a lower web 17 extending therefrom to lay adjacent the under surface of the batten 15 in use. The edge of the lower web 17 toward the leading edge 14 is provided with a locking lug 20 in the form of a ridge adapted to pass the batten 15 against the resilient bias of the downward depending web 16 and the lower web 17, to engage the leading face of the roof batten 15.

The clearance between the body portion 11 and the lower web 17 is such that the space accommodates the trailing edge 21 of an adjacent roofing element 10 to trap the trailing edge 21 between the underside of the body portion 11 and the batten 15.

Further installed security is provided by the backstop 13 engaging the upper leading edge of the adjacent batten 15.

Figure 4:
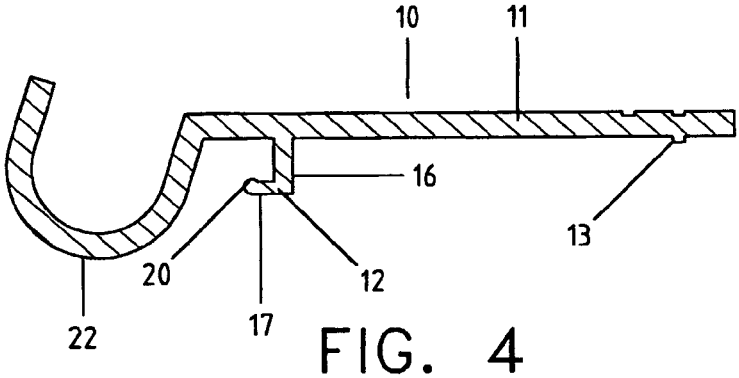
FIG. 4 is a guttered variant of the apparatus of FIG. 2.
Figure 5:
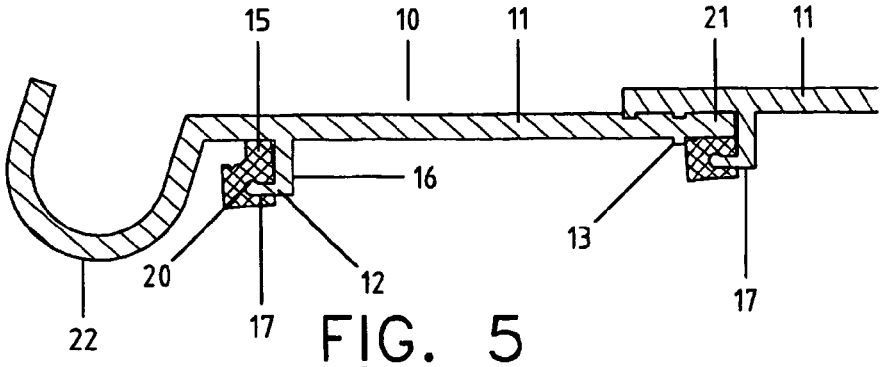
FIG. 5 is a side view of the apparatus of FIG. 4 in use.
Figure 6:
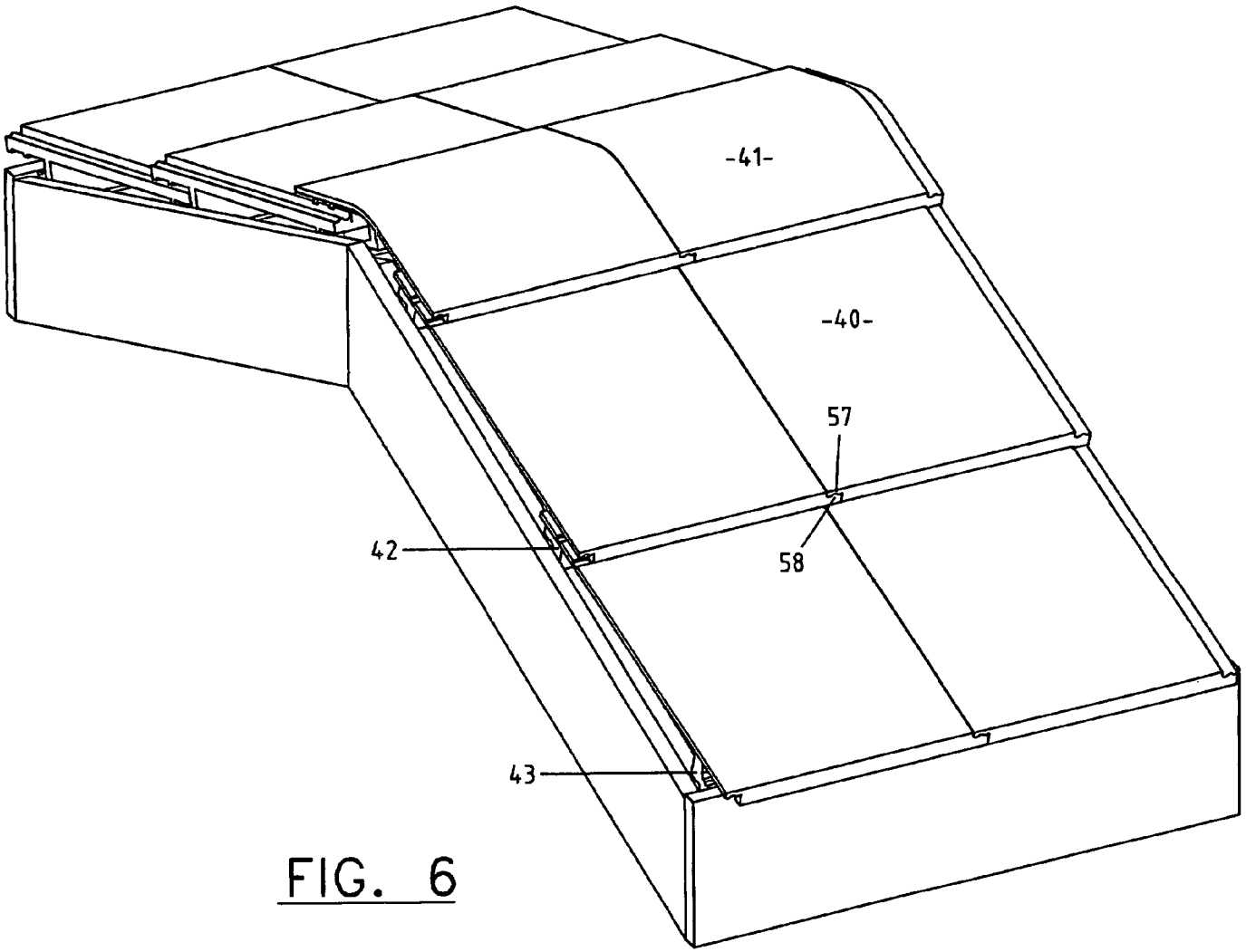
FIG. 6 is a perspective view of a cladding system in accordance with the present invention in use.
Figure 7:
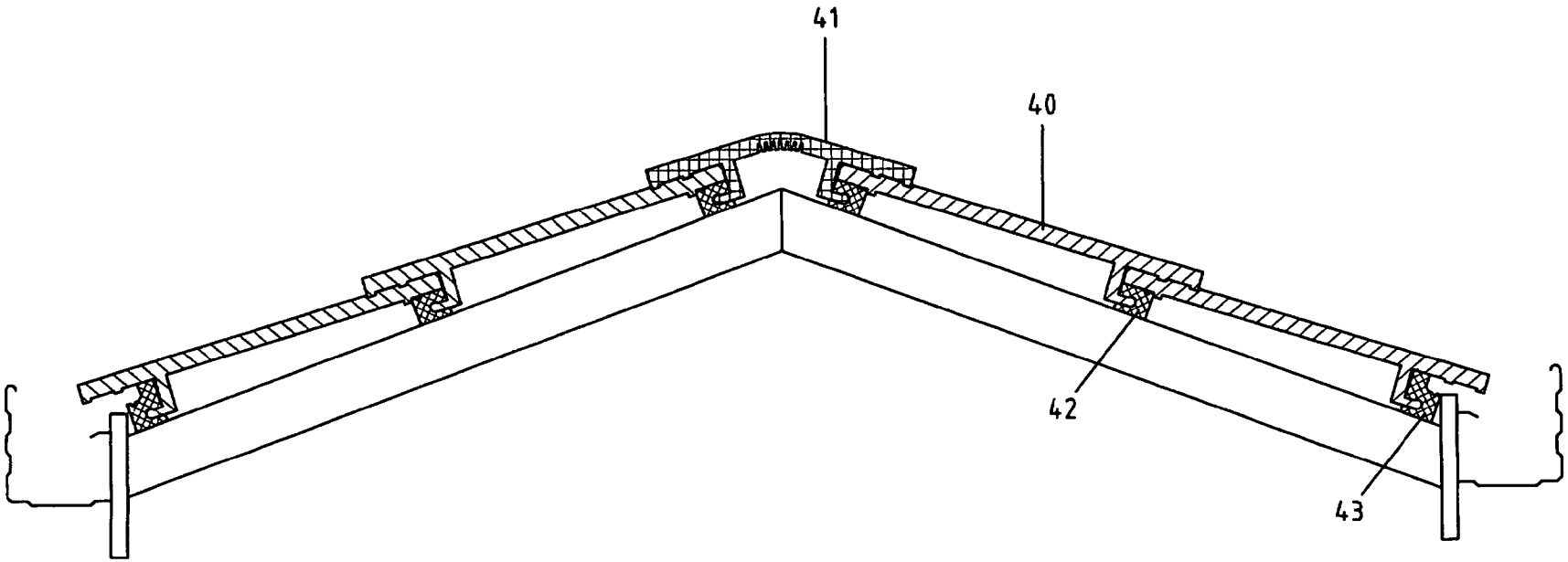
FIG. 7 is a section through the system of FIG. 6.
Figure 8:
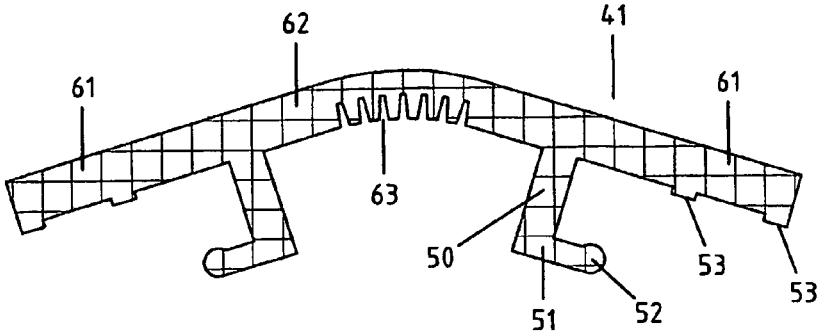
FIG. 8 is a detail end section of a roof capping suitable for use with the system of FIG. 6.
Figure 9:
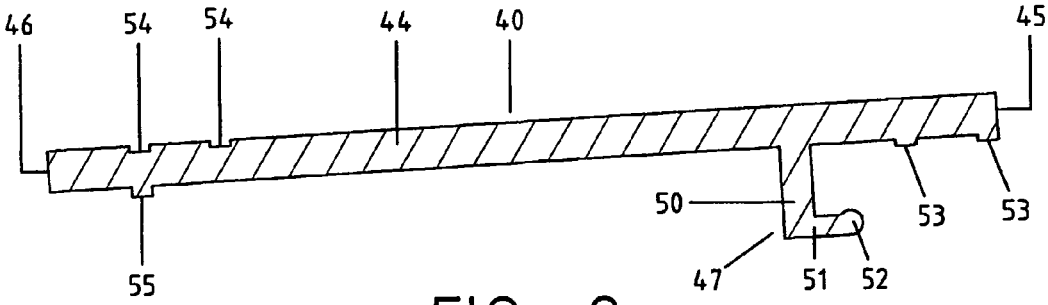
FIG. 9 is a detail side section of a cladding member suitable for use with the system of FIG. 6.
Figure 10:
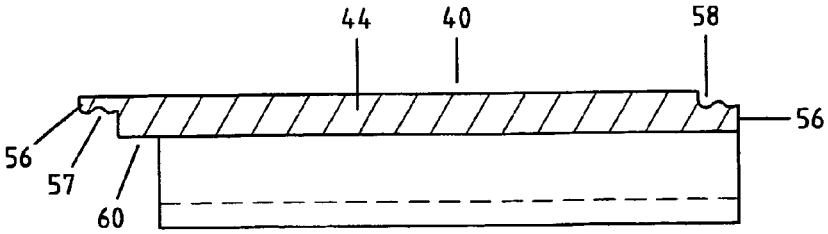
FIG. 10 is a detail end section of the cladding member of FIG. 9.
Figure 11:
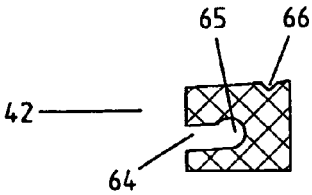
FIG. 11 is a section through a batten suitable for use with the system of FIG. 6.
Figure 12:
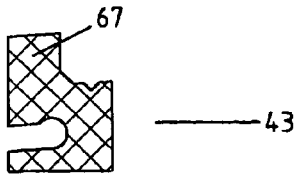
FIG. 12 is a section through a gutter-edge batten suitable for use with the system of FIG. 6.
Figure 14:
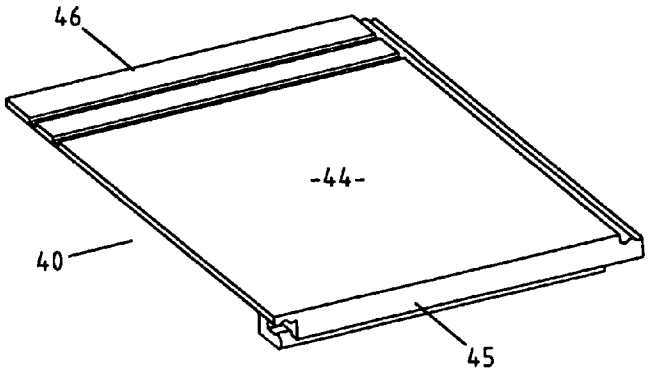
FIGS. 13 to 16 are isometric views of the cladding member of FIG. 9.
Figure 16:
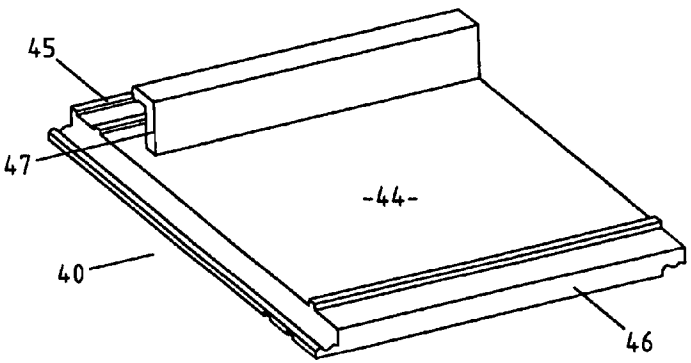
Figure 13:
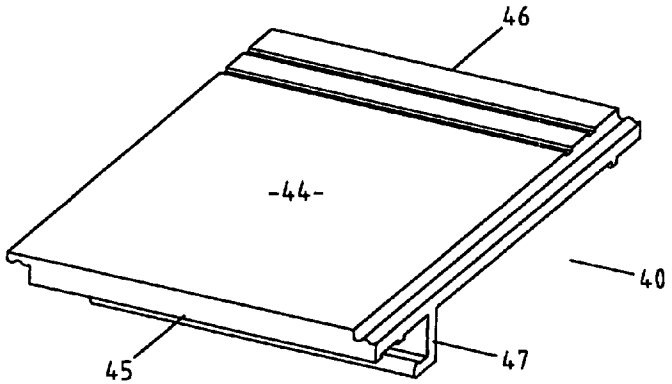
Figure 15:
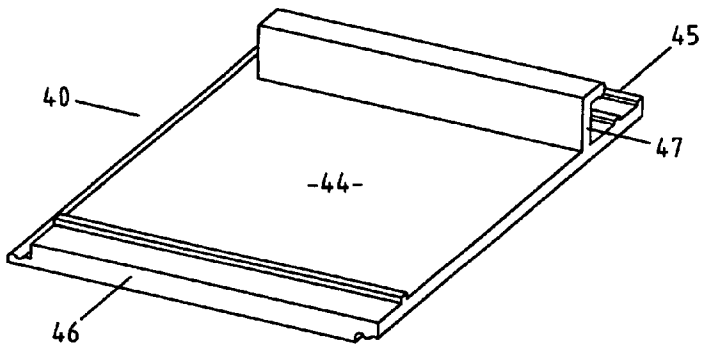

In the embodiment of FIGS. 4 and 5, the clearance between the body portion 11 and the lower web 17 is just sufficient to accommodate the batten 15, and the leading edge 14 is provided with an integrally formed gutter 22.

In the embodiment of FIGS. 6-16 there is provided a cladding system generally consisting of tile members 40, roof capping members 41, batten members 42 and starter batten members 43.

The tile members 40 generally comprise a substantially planar body portion 44 having a leading edge 45 and a trailing edge 46. Formed on the underside of the substantially planar body portion 44 and in the region of the leading edge 45 is a batten engagement portion 47 comprising an elongate web 50 extending out of the plane of the body portion 44 and having an elongate projection 51 integrally formed and extending in the direction of the leading edge 45. The projection 51 has at its outer extremity an enlarged portion 52.

Disposed between the leading edge 45 and the batten engagement portion 47 are a pair of spaced, elongate lugs 53. The lugs 53 are complementary to corresponding spaced elongate grooves 54 located on the upper surface of the body member 44 in the region of the trailing edge 46. Also in the region of the trailing edge 46 there is provided an elongate batten stop lug 55.

The body portion 44 has side edges 56 which have integrally formed thereon respective male 57 and female 58 labyrinth engagement portions enabling respective laterally adjacent tile members 40 to interengage in substantially weatherproof engagement.

The batten engagement portions 47 are relieved away from the male labyrinth engagement portion 57 at 60 to enable the necessary overlap on interengagement of the labyrinth engagement portions 57,58.

The roof capping members 41 comprise opposed engagement portions 61 which each include an elongate web 50, projection 51, enlarged portion 52 and elongate lugs 53 as per the corresponding structure of the tile members 40. The lugs 53 of the roof capping members 41 are adapted to engage the corresponding elongate grooves 54 of the uppermost tile members 40 in the roof cladding structure. Side edges of the roof capping members 41 are similarly provided with complementary male 57 and female labyrinth engagement portions, analogous to those used in the tile members 40.

The opposed engagement portions 61 are interconnected by a ridge portion 62. The ridge portions 62 are relieved by a plurality of tapered grooves 63 which permit the roof capping members 41 to flex at the ridge portion 62 to enable the roof capping members 41 to be used on roofs of a wide variety of pitches.

The batten members 42 are provided with an elongate recess 64 adapted to receive the projection 51, the inner edge of 65 of the recess 64 being enlarged to accept the enlarged portion 52 of the projection 51. An elongate V-groove 66 provides a nailing line to aid in fixing the batten to a stud wall or roof truss assembly.

The starter batten members 43 are substantially as per the batten members 42 with the addition of a spacer lug 67.

Figure 17:
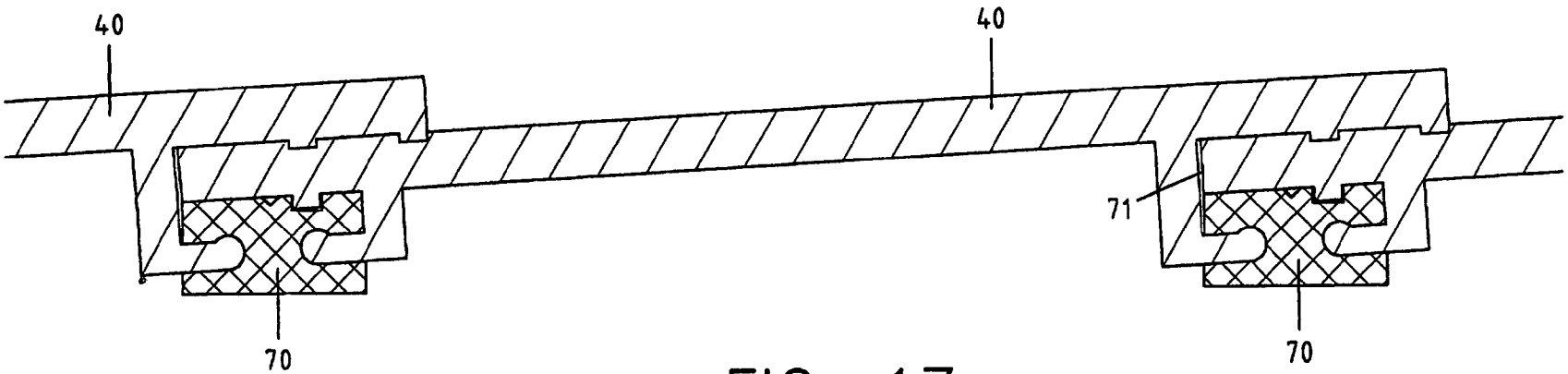
FIG. 17 is a section view of an alternative cladding system in accordance with the present invention in use.

In the embodiment of FIG. 17 it can be seen that batten members 70 are provided with both leading and trailing recesses of the kind labelled 64 in the prior embodiment, the tile members 40 being correspondingly supplied with batten engagement portions 47 with their attendant elongate webs 50 and projections 51, at both the leading and trailing portions of the tile members 40.

The batten members 42, starter batten members 43 and batten members 70 are all of slightly tapered form whereby in use a clearance 71 is produced between the leading edge 46 and the elongate web 50 of the next adjacent tile member 40.

It will of course be realised that while the above has been given by way of illustrative example of this invention, all such and other modifications and variations thereto as would be apparent to persons skilled in the art are deemed to fall within the broad scope and ambit of this invention as is herein set forth.

The invention claimed is:

1. A method of installing cladding, the method including the steps of:

installing spaced, substantially horizontal battens on a structure to be clad;

installing a cladding apparatus having a body portion having an inner and an outer surface and extending from a leading edge to a trailing edge between opposed side edges, and a batten engagement portion disposed on said inner surface toward said leading edge and adapted to retain said body portion against leading and outward movement relative to a batten engaged thereby, a leading edge portion of the inner surface of said body portion entrapping a trailing edge of an adjacent cladding apparatus against an upper surface of said batten, said batten engagement portion being configured to provide for mutual interengagement with a corresponding configuration of said batten, said mutual interengagement being provided by said batten including a recess formed on a trailing batten edge thereof, and wherein the batten engagement portion includes a projection in a leading direction that engages the recess in use, and the leading edge portion of the inner surface of the body portion and a trailing edge portion of the outer surface of the body portion of the adjacent cladding apparatus each being provided with respective lugs and grooves so that when the trailing edge of the adjacent cladding apparatus is entrapped, the lugs on the inner surface of the body portion are interdigitated with the lugs on the outer surface of the body portion of the adjacent cladding apparatus.

2. The method of installing cladding of claim 1, wherein the structure is selected from an internal or external wall, a roof or a ceiling.

3. The method of installing cladding members of claim 1, wherein said batten engagement portion extends substantially across the inner surface.

4. A cladding apparatus including:

a body portion having an inner and an outer surface and extending from a leading edge to a trailing edge between opposed side edges;

a batten engagement portion disposed on said inner surface toward said leading edge and adapted to retain said body portion against leading and outward movement relative to a batten engaged thereby, a leading edge portion of the inner surface of the body portion entrapping a trailing edge of an adjacent cladding apparatus against an upper surface of said batten, said batten engagement portion being configured to provide for mutual interengagement with a corresponding configuration of said batten, said mutual interengagement being provided by said batten including a recess formed on a trailing batten edge thereof, and wherein the batten engagement portion includes a projection in a leading direction that engages the recess in use; and the leading edge portion of the inner surface of the body portion and a trailing edge portion of the outer surface of the body portion being provided with respective lugs and grooves arranged so that when the trailing edge of the adjacent cladding apparatus is entrapped, the lugs on the inner surface of the body portion are interdigitated with the lugs on the outer surface of the body portion of the adjacent cladding apparatus.

5. The cladding apparatus according to claim 4, wherein said body portion is in the form of discrete elements selected from roof tiles or sheet, cladding board members, or shingles, or a continuous roll or strip element.

6. The cladding apparatus according to claim 5, wherein said body portion is in the form of discrete elements having side edges being mutually configured to permit overlap between adjacent elements across the pitch of a roof or width of a wall.

7. The cladding apparatus according to claim 4, wherein said body portion is of a form selected from generally planar, corrugated or profiled.

8. The cladding apparatus according to claim 7, wherein said body portion is profiled in a manner that permits stacking of the roofing elements for transport.

9. The cladding apparatus according to claim 4, wherein the body portion and the batten engagement portion are integrally formed of a moldable or extrudable plastics material.

10. The cladding apparatus according to claim 9, wherein said plastics material is selected from stabilized recycled plastic.

11. The cladding apparatus according to claim 4, including batten abutment means extending substantially across the underside of the body portion.

12. The cladding apparatus according to claim 4, wherein said batten engagement portion is interrupted to allow the installation of the element about the battens between wall studs or roof truss elements.

13. The cladding apparatus according to claim 4, wherein said recess comprises an elongate slot into which the projection is forced against a resilient bias of the material of the batten about the recess, the inner end of the recess being provided with an enlarged cross section into which a correspondingly formed edge of the projection clips.

14. The cladding apparatus according to claim 4, wherein said elongate projection and the elongate recess are mutually configured whereby the cladding member slides laterally into engagement with the batten member.

15. The cladding apparatus according to claim 4, wherein there is further provided a batten stop portion associated with said inner surface toward the trailing edge thereof and adapted to bear on a leading face of an adjacent trailing batten, the batten engagement portion and body portion adjacent said leading edge being mutually configured to retain the trailing edge portion of an adjacent cladding member to said leading batten.

16. The cladding apparatus according to claim 4, wherein said batten engagement portion extends substantially across the inner surface.

* * * * *